US011247084B2

(12) United States Patent
Fischer

(10) Patent No.: US 11,247,084 B2
(45) **Date of Patent: *Feb. 15, 2022**

(54) DRYER APPLIANCE HAVING A FIRE EXTINGUISHING SYSTEM EQUPPED WITH A MULTIWAY INLET VALVE

(71) Applicant: Haier US Appliance Solutions, Inc., Wilmington, DE (US)

(72) Inventor: Austin Robert Fischer, Amelia, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 157 days.

This patent is subject to a terminal disclaimer.

(21) Appl. No.: 16/654,636

(22) Filed: Oct. 16, 2019

(65) Prior Publication Data

US 2021/0113867 A1 Apr. 22, 2021

(51) Int. Cl.

| | |
|---|---|
| ***F26B 21/06*** | (2006.01) |
| ***A62C 3/00*** | (2006.01) |
| ***D06F 39/08*** | (2006.01) |
| ***A62C 35/68*** | (2006.01) |
| ***D06F 58/30*** | (2020.01) |
| *D06F 58/50* | (2020.01) |
| *D06F 105/02* | (2020.01) |

(52) U.S. Cl.

CPC ..... *A62C 3/00* (2013.01); *A62C 35/68* (2013.01); *D06F 39/088* (2013.01); *D06F 58/30* (2020.02); *D06F 58/50* (2020.02); *D06F 2105/02* (2020.02)

(58) Field of Classification Search

CPC .. A62C 3/00; A62C 35/68; A62C 3/16; D06F 58/30; D06F 58/50; D06F 58/203; D06F 58/02; D06F 58/20; D06F 39/088; D06F 2105/02; D06F 2105/54; D06F 37/42; D06F 2103/00

USPC ..... 34/544

See application file for complete search history.

(56) References Cited

U.S. PATENT DOCUMENTS

| | | | | |
|---|---|---|---|---|
| 9,109,324 | B2 | 8/2015 | Chatot et al. | |
| 9,359,706 | B2 * | 6/2016 | Lundbom | D06F 58/50 |
| 2019/0022440 | A1 * | 1/2019 | Chattaway | A62C 3/08 |

FOREIGN PATENT DOCUMENTS

| | | | |
|---|---|---|---|
| KR | 101118620 | B1 | 3/2012 |
| WO | WO2009008631 | A1 | 1/2009 |

* cited by examiner

*Primary Examiner* — John P McCormack
(74) *Attorney, Agent, or Firm* — Dority & Manning, P.A.

(57) ABSTRACT

A dryer appliance that includes a fire extinguishing system is provided. In one aspect, the dryer appliance includes a drum rotatably mounted within a cabinet. The drum defines a chamber for receipt of articles for drying. The dryer appliance includes a water inlet valve in fluid communication with a steam nozzle operable to deliver water into the chamber to form mist or steam. The dryer appliance also includes an extinguisher nozzle in fluid communication with the chamber of the drum and with the water inlet valve. Upon detection of a fire, water is provided to the extinguisher nozzle and the extinguisher nozzle directs a stream of water into the chamber to extinguish the detected fire.

20 Claims, 6 Drawing Sheets

DRYER APPLIANCE HAVING A FIRE EXTINGUISHING SYSTEM EQUPPED WITH A MULTIWAY INLET VALVE

FIELD OF THE INVENTION

The present subject matter relates generally to dryer appliances, and more particularly to dryer appliances having fire-extinguishing features.

BACKGROUND OF THE INVENTION

In rare instances, dryer appliances can catch on fire. For instance, clothes within a rotatably mounted drum of a dryer appliance can catch on fire during a drying cycle. Some conventional dryer appliances include a fire extinguishing or containment system to extinguish and/or contain detected fires within the drum. However, such conventional fire systems have proven to be unsatisfactory. For instance, some systems are only capable of containing the fire within the drum. Other systems are able to extinguish fires but add significant cost to the unit.

Accordingly, a dryer appliance and methods of operating the same that address one or more of the challenges noted above would be advantageous.

BRIEF DESCRIPTION OF THE INVENTION

Aspects and advantages of the invention will be set forth in part in the following description, or may be obvious from the description, or may be learned through practice of the invention.

In one aspect, a dryer appliance is provided. The dryer appliance includes a cabinet and a drum rotatably mounted within the cabinet. The drum defines a chamber for receipt of articles for drying. Further, the dryer appliance includes a steam nozzle in fluid communication with the chamber of the drum and an extinguisher nozzle in fluid communication with the chamber of the drum. The dryer appliance also includes a water inlet valve in fluid communication with a water supply. The water inlet valve is movable to a first position and a second position. Wherein i) when the water inlet valve is in the first position, the water inlet valve allows water to flow from the water supply downstream to the extinguisher nozzle and the extinguisher nozzle directs a stream of water into the chamber, and ii) when the water inlet valve is in the second position, the water inlet valve prevents water from flowing downstream to the extinguisher nozzle.

In another aspect, a dryer appliance is provided. The dryer appliance includes a cabinet and a drum rotatably mounted within the cabinet. The drum defines a chamber for receipt of articles for drying. The dryer appliance also includes a steam nozzle in fluid communication with the chamber of the drum and an extinguisher nozzle in fluid communication with the chamber of the drum. The dryer appliance further includes a water inlet valve in fluid communication with a water supply, the steam nozzle, and the extinguisher nozzle. Moreover, the dryer appliance includes a fire detection device operable to detect fires. The dryer appliance also includes a controller communicatively coupled with the fire detection device and the water inlet valve. The controller is configured to: receive, from the fire detection device, an input indicating that a fire is present in the dryer appliance; and in response to the received input, cause the water inlet valve to allow water from the water supply to flow downstream to the extinguisher nozzle so that the extinguisher nozzle directs a stream of water into the chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
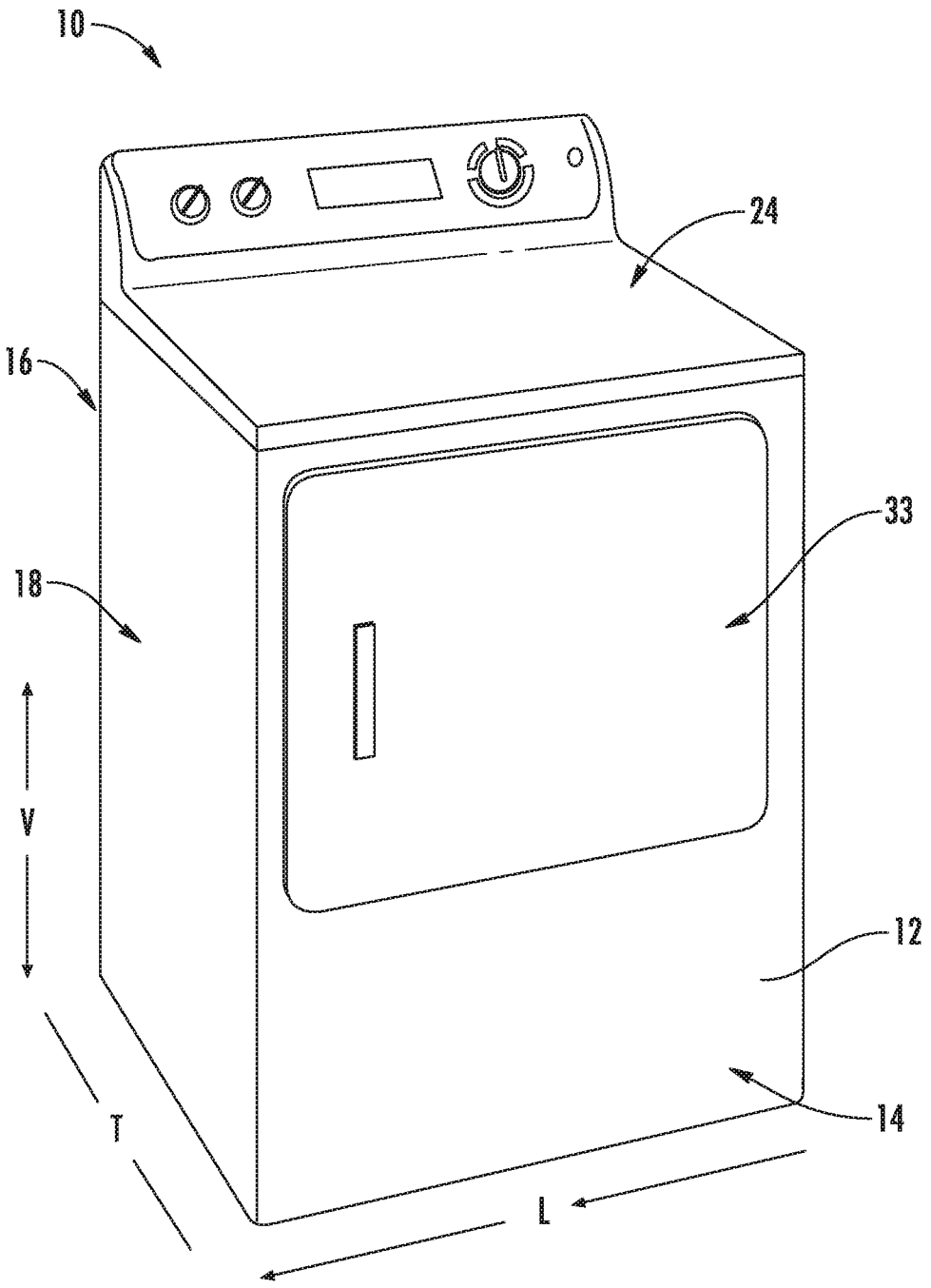
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
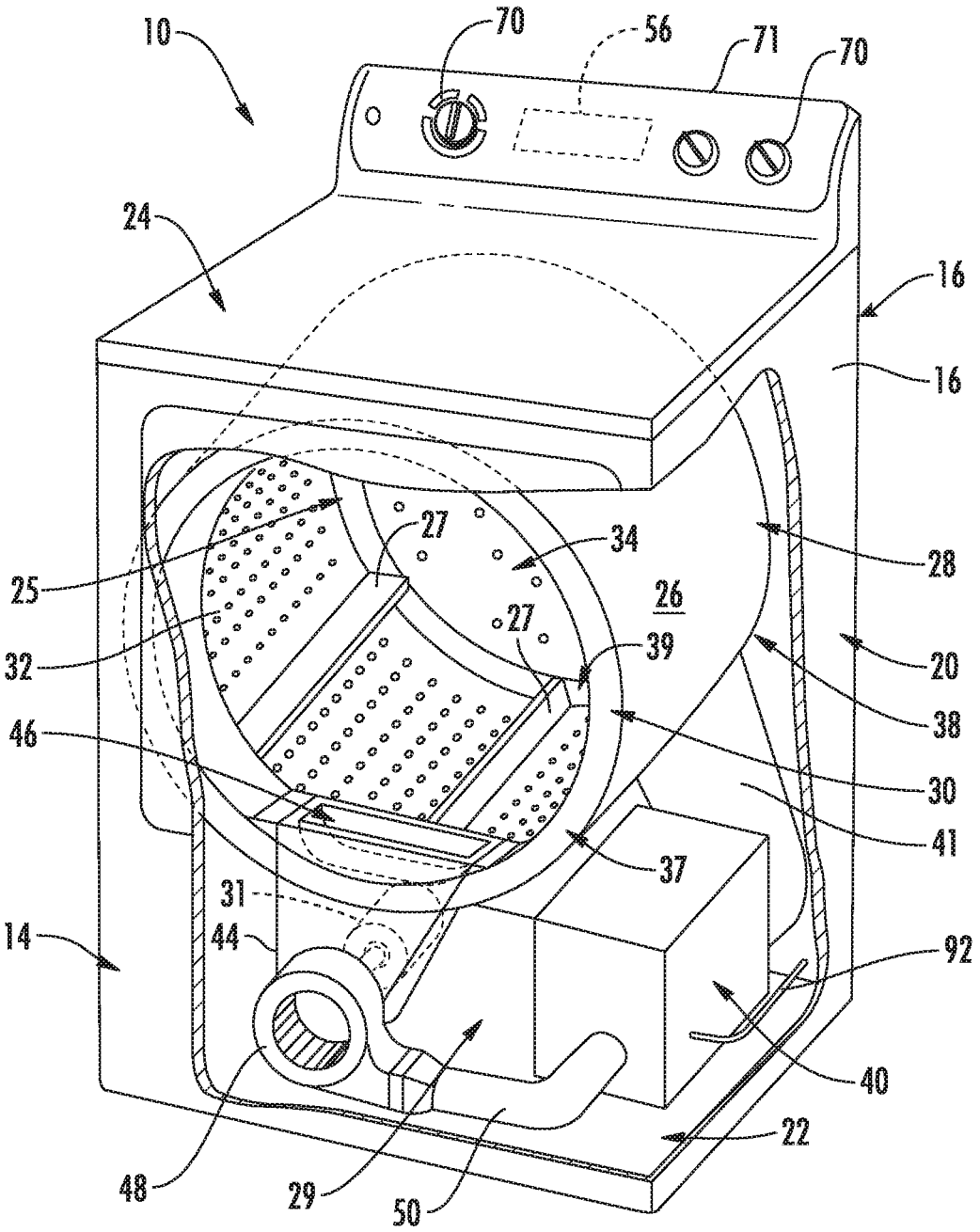
FIG. 2 provides a perspective view of the example dryer appliance of FIG. 1 with portions of a cabinet of the dryer appliance removed to reveal certain components of the dryer appliance.

FIGS. 1 and 2 provide perspective views of a dryer appliance 10 according to exemplary embodiments of the present disclosure. Particularly, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10. As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For instance, in some embodiments, dryer appliance 10 can be a combination washing machine/dryer appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 defines an interior volume 29. A drum 26 is mounted for rotation about a substantially horizontal axis within the interior volume 29 of cabinet 12. Drum 26 defines a chamber 25 for receipt of articles for tumbling and/or drying. Drum 26 extends between a front portion 37 and a rear portion 38, e.g., along the transverse direction T. Dryer appliance 10 also includes a back or rear drum support 34 that forms a rear wall of drum 26 when assembled thereto. In this way, rear drum support 34 encloses chamber 25 of drum 26 at rear portion 38. For this embodiment, rear drum support 34 is stationary. A supply duct 41 may be mounted to rear drum support 34. Supply duct 41 receives heated air that has been heated by a conditioning system 40 and provides the heated air to drum 26 via one or more holes or openings defined by rear drum support 34.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange 30 that defines an opening 32 of drum 26, e.g., at front portion 37 of drum 26, for loading and unloading of articles into and out of chamber 25 of drum 26. Front flange 30 can be lined with felt to allow drum 26 to rotate more efficiently by reducing friction between drum 26 and a front drum support. Drum 26 also includes a rear flange 39, e.g., at rear portion 38 of drum 26. Like front flange 30, rear flange 39 can be lined with felt to allow drum 26 to rotate more efficiently by reducing friction between drum 26 and rear drum support 34. Furthermore, drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear drum support 34 can include a plurality of holes or openings that receive hot air that has been heated by a conditioning system 40. Moisture laden, heated air is drawn from drum 26 by an air handler, such as a blower fan 48, which generates a negative air pressure within drum 26. The moisture laden heated air passes through a duct 44 enclosing screen filter 46, which traps lint particles. As the air passes from blower fan 48, it enters a duct 50 and then is passed into conditioning system 40. In some embodiments, the conditioning system 40 can be or include an electric heating element, e.g., a resistive heating element, or a gas-powered heating element, e.g., a gas burner. For this embodiment, dryer appliance 10 is a heat pump dryer appliance and thus conditioning system 40 can be or include a heat pump including a sealed refrigerant circuit. Heated air (with a lower moisture content than was received from drum 26), exits conditioning system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are communicatively coupled with (e.g., electrically coupled or coupled through a wireless network band) a processing device or controller 56. Controller 56 may also be communicatively coupled with various operational components of dryer appliance 10, such as motor 31, blower 48, components of conditioning system 40, and other components of dryer appliance 10. In turn, signals generated in controller 56 direct operation of motor 31, blower 48, conditioning system 40, and/or other components of dryer appliance 10 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56. As will be explained further below, controller 56 can control various components of dryer appliance 10 in the event a fire is detected in chamber 25 of drum 26.

Figure 3:
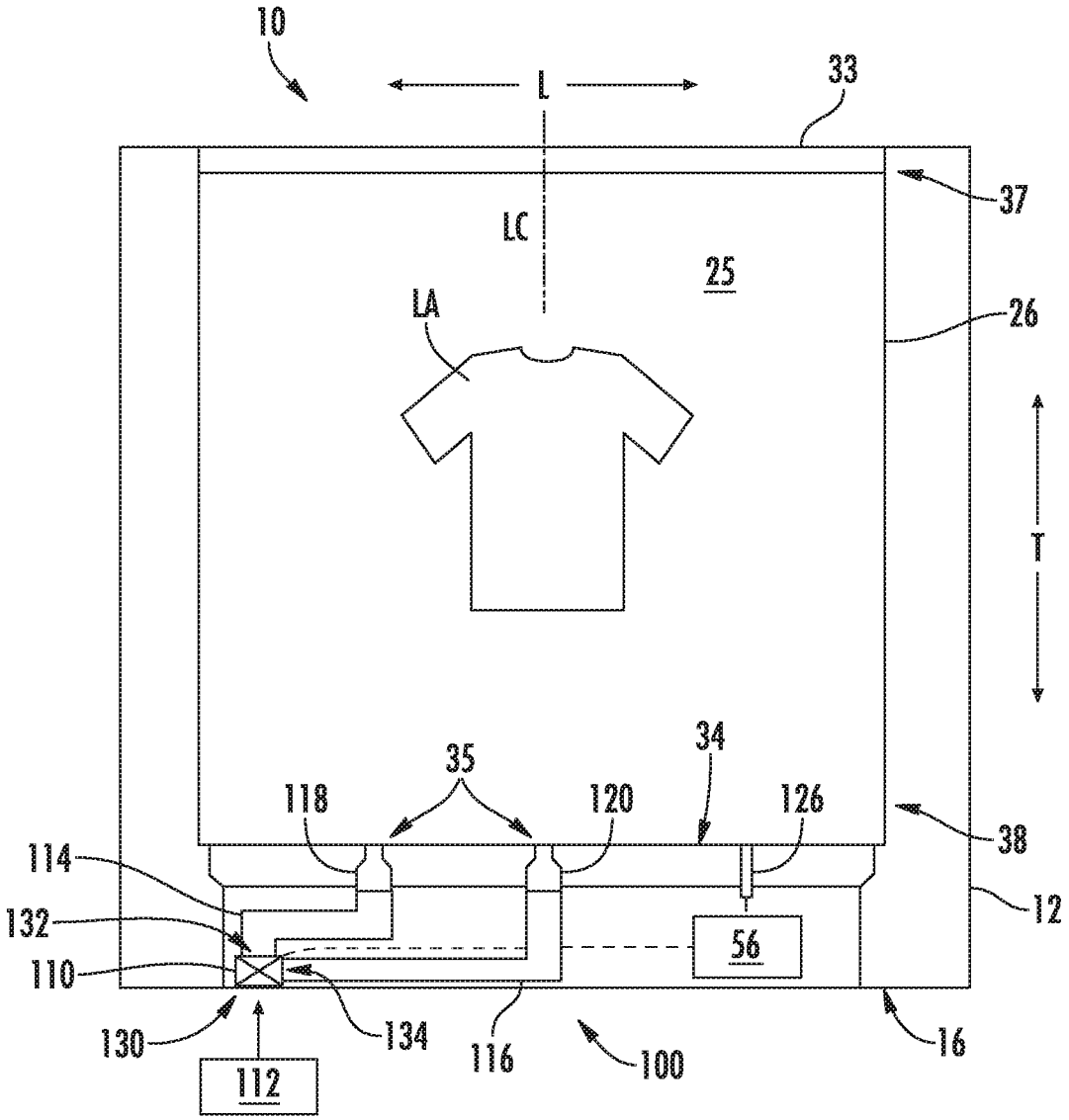
FIG. 3 provides a schematic top view of the dryer appliance and depicts a fire extinguishing system thereof.

FIG. 3 provides a schematic top view of dryer appliance 10 and depicts a fire extinguishing system 100 thereof. Generally, fire extinguishing system 100 is operable to extinguish a detected fire. More particularly, fire extinguishing system 100 includes features for automatically detecting and extinguishing a fire in or around chamber 25 of drum 26. Various components of fire extinguishing system 100 will be described below.

As depicted, dryer appliance 10, and more particularly fire extinguishing system 100, includes a water inlet valve 110. For this embodiment, water inlet valve 110 is mounted to rear panel 16 of cabinet 12. Water inlet valve 110 is in fluid communication with a water supply 112. In this manner, water can flow from water supply 112 downstream to water inlet valve 110. Water supply 112 can be any suitable source or supply of water. As one example, water supply 112 can be a water line of a consumer's home. Thus, in some embodiments, water supply 112 is a continuous water supply. Meaning, water supply 112 need not be refilled manually and water is readily available.

Water inlet valve 110 can be any suitable type of valve. As one example, water inlet valve 110 can be a solenoid valve, e.g., such as a three-way solenoid valve. As another example, water inlet valve 110 can be a control valve operable to control the flow rate of water therethrough, e.g., based on one or more control commands from controller 56. Water inlet valve 110 is communicatively coupled with controller 56, e.g., via a suitable wired and/or wireless communication link.

Water inlet valve 110 has at least two outlets and an inlet. Particularly, for this embodiment, water inlet valve 110 has an inlet 130, a first outlet 132, and a second outlet 134. In some embodiments, water inlet valve 110 can have more than two outlets. Water from water supply 112 can flow downstream and enter water inlet valve 110 through inlet 130. A first delivery conduit 114 (e.g., a hose) fluidly connects first outlet 132 of water inlet valve 110 with an inlet of a steam nozzle 118. A second delivery conduit 116 (e.g., a hose) fluidly connects second outlet 134 of water inlet valve 110 with an inlet of an extinguisher nozzle 120.

Steam nozzle 118 is in fluid communication with water inlet valve 110 and with chamber 25 of drum 26. Particularly, as noted above, an inlet of steam nozzle 118 is fluidly connected with first outlet 132 of water inlet valve 110 via first delivery conduit 114. An outlet of steam nozzle 118 is in fluid communication with chamber 25 of drum 26, e.g., via one or more holes or openings 35 defined by rear drum support 34. When water is provided to steam nozzle 118, steam nozzle 118 is operable to deliver or direct water into chamber 25 (e.g., a mist-like spray) to form a mist or steam therein. The diameter of the outlet of steam nozzle 118 is sized such that the water directed into chamber 25 mixes with the air to become mist or steam. In this manner, during a drying cycle and/or thereafter, the laundry articles LA within chamber 25 can be steamed. Thus, the laundry articles LA may be less prone to wrinkling, among other benefits.

Extinguisher nozzle 120 is in fluid communication with water inlet valve 110 and with chamber 25 of drum 26. Particularly, as described above, an inlet of extinguisher nozzle 120 is fluidly connected with second outlet 134 of water inlet valve 110 via second delivery conduit 116. An outlet of extinguisher nozzle 120 is in fluid communication with chamber 25 of drum 26, e.g., via one or more of the holes or openings 35 defined by rear drum support 34. For this embodiment, extinguisher nozzle 120 is positioned or oriented along a lateral centerline LC that extends midway between the left and right side of drum 26 along the lateral direction L. In this way, extinguisher nozzle 120 is centrally positioned to extinguish a detected fire. In other embodiments, extinguisher nozzle 120 can be located in other positions.

Figure 4:
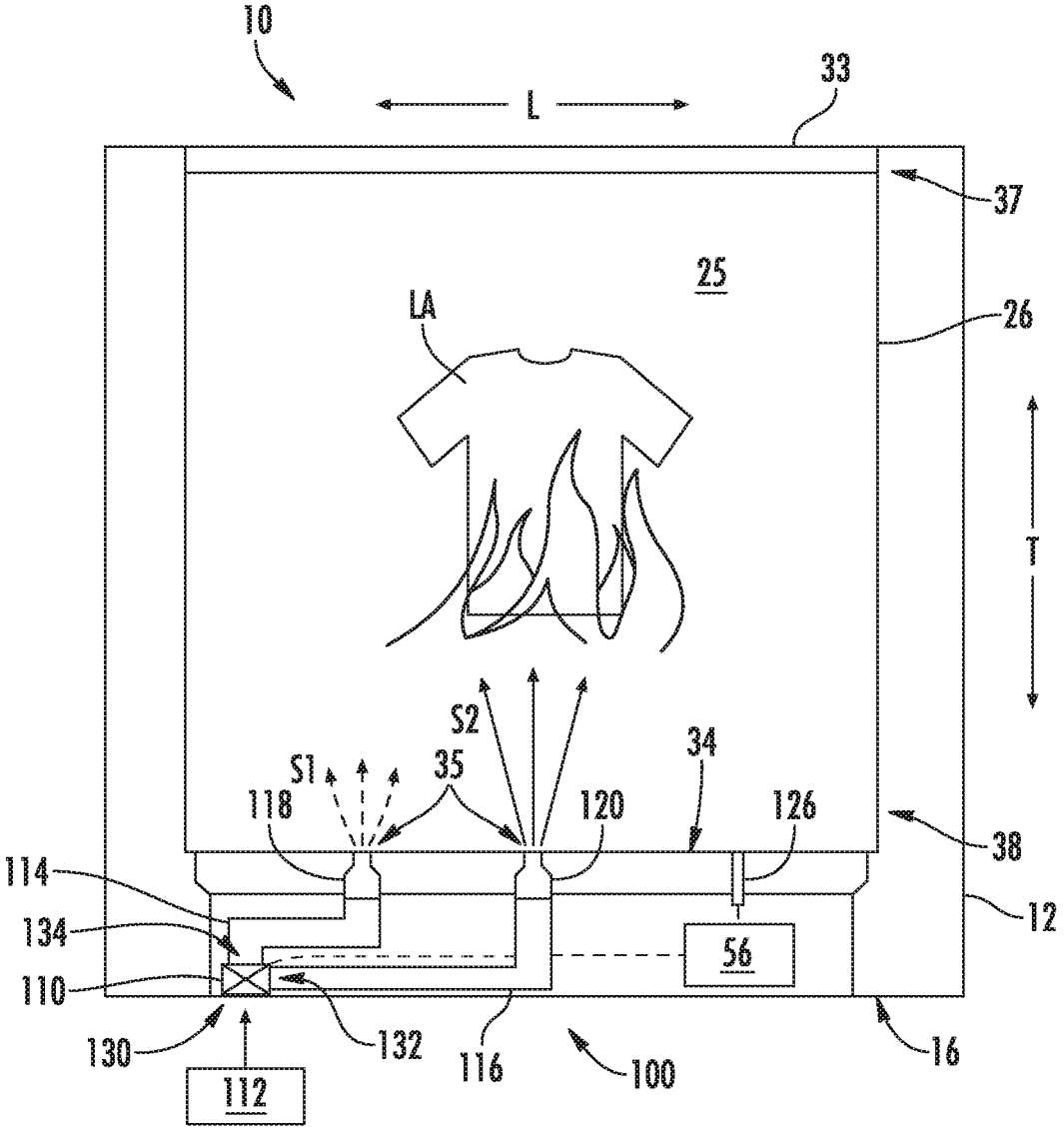
FIG. 4 provides another schematic top view of the dryer appliance and depicts the fire extinguishing system performing an extinguishing operation.

When water is provided to extinguisher nozzle 120, extinguisher nozzle 120 is operable to deliver or direct a stream of water into chamber 25 of drum 26, e.g., to extinguish a fire as shown in FIG. 4. Notably, the diameter of the outlet of extinguisher nozzle 120 is sized such that the stream of water directed into chamber 25 exits extinguisher nozzle 120 having a volume sufficient to extinguish a fire within chamber 25. Thus, for this embodiment, the diameter of the outlet of extinguisher nozzle 120 is greater than the diameter of the outlet of steam nozzle 118.

Dryer appliance 10 also includes a fire detection device 126. Fire detection device 126 is operable to detect dryer fires, and more particularly, fires within chamber 25 of drum 26. Fire detection device 126 can be any suitable type of device capable of detecting a fire. For instance, in some embodiments, fire detection device 126 can be a temperature sensor. In other embodiments, fire detection device 126 can be a smoke sensor. In yet other embodiments, fire detection device 126 can be a camera (e.g., a fire resistant camera). Fire detection device 126 is communicatively coupled with controller 56, e.g., via a suitable wired and/or wireless communication link. In this manner, controller 56 can receive one or more inputs from fire detection device 126. For instance, controller 56 can receive an input from fire detection device 126 indicating that a fire is present in chamber 25 of drum 26.

In yet other embodiments, fire detection device 126 can be a thermostat having a fire sensing device and an onboard controller. The onboard controller can have or include any of the components described above with respect to controller 56, e.g., one or more processors and one or more memory devices, such as non-transitory readable media. In such embodiments, the thermostat can be communicatively coupled with water inlet valve 110 as well as other components of dryer appliance 10, such as controller 56.

As further shown in FIG. 3, various components of fire extinguisher system 100 are supported by rear drum support 34. Rear drum support 34 generally supports drum 26 at rear portion 38 of drum 26 and also encloses chamber 25 at rear portion 38. A first opening (labeled as 35 in FIG. 3) defined by rear drum support 34 can support and hold steam nozzle 118. A second opening (labeled as 35 in FIG. 3) defined by rear drum support 34 can support and hold extinguisher nozzle 120. A third opening defined by rear drum support 34 can support and hold fire detection device 126. Moreover, for this embodiment, steam nozzle 118 and extinguisher nozzle 120 are located at the rear of dryer appliance 10, e.g., at rear portion 38 of drum 26. In this manner, less pluming to the nozzles 118, 120 is required, e.g., compared to systems having nozzles at a middle or forward portion of drum 26. Thus, the positioning of the nozzles 118, 120 as depicted in FIG. 3 may provide a cost benefit.

Notably, water inlet valve 110 is movable to a first position and a second position. In some embodiments, water inlet valve 110 can be movable to more than two (2) positions. Generally, when water inlet valve 110 is in or moved to the first position, water inlet valve 110 allows water to flow from water supply 112 downstream to extinguisher nozzle 120. When water is supplied to extinguisher nozzle 120, extinguisher nozzle 120 directs a stream of water into chamber 25, e.g., to extinguish a fire therein. In contrast, when water inlet valve 110 is in the second position, water inlet valve 110 prevents water from flowing downstream to extinguisher nozzle 120.

In some embodiments, when water inlet valve 110 is in the first position, water inlet valve 110 prevents water from flowing downstream to the steam nozzle 118. Thus, in such embodiments, when water inlet valve 110 is in the first position, water inlet valve 110 allows water to flow from water supply 112 to extinguisher nozzle 120 but not to steam nozzle 118. In other embodiments, when water inlet valve 110 is in the first position, water inlet valve 110 allows water to flow from the water supply 112 downstream to steam nozzle 118 and steam nozzle 118 in turn directs water into chamber 25 to form a mist or steam therein. Accordingly, in such embodiments, when water inlet valve 110 is in the first position, water inlet valve 110 allows water to flow from water supply 112 to both extinguisher nozzle 120 and to steam nozzle 118.

Further, in some embodiments, when water inlet valve 110 is in the second position, water inlet valve 110 allows water to flow from water supply 112 downstream to steam nozzle 118 and steam nozzle 118 in turn directs water into chamber 25 of drum 26 to form a mist or steam therein. Thus, in such embodiments, when water inlet valve 110 is in the second position, water inlet valve 110 allows water to flow from water supply 112 downstream to steam nozzle 118 but prevents water from flowing to extinguisher nozzle 120. In yet other embodiments, when water inlet valve 110 is in the second position, water inlet valve 110 prevents water from flowing from water supply 112 to steam nozzle 118 and prevents water from flowing from water supply 112 to extinguisher nozzle 120. In some embodiments, when water inlet valve 110 is in the second position, water inlet valve 110 prevents water from flowing from water supply 112 into the dryer appliance 110.

Stated another way, in some example embodiments, water inlet valve 110 can be moved between a first open position, a second open position, and a third or closed position. In the first open position, water inlet valve 110 allows water to flow from water supply 112 to extinguisher nozzle 120 but not to steam nozzle 118. In the second open position, water inlet valve 110 allows water to flow from water supply 112 to steam nozzle 118 but not to extinguisher nozzle 120. In the third position, water inlet valve 110 is closed and thus water flows downstream to neither steam nozzle 118 nor extinguisher nozzle 120. In other example embodiments, water inlet valve 110 can be moved between an open position and a closed position. In the open position, water inlet valve 110 allows water to flow from water supply 112 to extinguisher nozzle 120 and steam nozzle 118. In the closed position, water inlet valve 110 prevents water from flowing to extinguisher nozzle 120 and to steam nozzle 118.

An example manner in which fire extinguisher system 100 of dryer appliance 10 can extinguish a detected fire will now be described. During operation of dryer appliance 10 in a drying cycle or at any time in which dryer appliance 10 is supplied electrical power (even in a standby mode), dryer appliance 10 can monitor for fires. Particularly, fire detection device 126 can monitor for fires. Fire detection device 126 can monitor for fires continuously or at a predetermined interval, e.g., every five (5) seconds. Fire detection device 126 can monitor for fires and can send and controller 56 can receive one or more electrical signals indicating whether a fire is present in dryer appliance 10. Specifically, when fire detection device 126 senses that a fire is present in drum 26, controller 56 can receive an input from fire detection device 126 indicating that a fire has been detected, e.g., in chamber 25 of drum 26.

In some embodiments, for example, fire detection device 126 can be a temperature sensing device having a set point temperature corresponding to an ignition temperature at which a predetermined fabric type is likely to catch fire. The predetermined fabric can be cotton, polyester, etc., for example. When the temperature sensing device senses a temperature within drum 26 that exceeds the set point temperature, controller 56 can receive an input from the temperature sensing device indicating that a fire is present within drum 26.

Upon receiving an input indicating that a fire is present within dryer appliance 10, e.g., within chamber 25 of drum 26, controller 56 is configured to take action to extinguish the fire. More particularly, in response to receiving an input indicating that a fire is present within dryer appliance 10, controller 56 is configured to cause water inlet valve 110 to move to the first position. For instance, controller 56 can send and water inlet valve 110 can receive one or more control commands that cause water inlet valve 110 to move to the first position. In this way, water flows from water supply 112 downstream into dryer appliance 10 and ultimately to extinguisher nozzle 120. As noted, water supply 112 can be a readily available, continuous water supply and thus water can be supplied to extinguish the fire at any moment.

As shown best in FIG. 4, when controller 56 causes water inlet valve 110 to move from the second position to the first position in response to the one or more signals indicating that a fire has been detected, water flows from water supply 112 downstream into dryer appliance 10 and through open water inlet valve 110. The water continues downstream along second delivery conduit 116 to extinguisher nozzle 120. When the water reaches extinguisher nozzle 120, the pressure of the water is increased by extinguisher nozzle 120 and the water is then ejected in a liquid stream (e.g., a jet-like stream) from extinguisher nozzle 120 into chamber 25 of drum 26 as shown by the arrows labeled as "S2" in FIG. 4. The stream S2 ejected from extinguisher nozzle 120 is sufficient in volume to readily extinguish drum fires.

In some embodiments, as noted above, when controller 56 causes water inlet valve 110 to move to the first position, a portion of water can flow downstream to steam nozzle 118 in addition to the portion of water flowing downstream to the extinguisher nozzle 120. Upon receiving the portion of water, steam nozzle 118 delivers or directs water into chamber 25 of drum 26. However, as detailed above, the outlet of steam nozzle 118 is sized such that water exits steam nozzle 118 in a mist-like spray denoted by the arrows labeled as "S1" in FIG. 4, which may be insufficient to extinguish a drum fire. In other embodiments, when controller 56 causes water inlet valve 110 to move to the first position, water is prevented from flowing from water supply 112 to steam nozzle 118. In this manner, all of the water flowing downstream from water supply 112 to dryer appliance 10 is directed to extinguisher nozzle 120. This can, for example, increase the volume of water directed to extinguisher nozzle 120 and thus improve the fire extinguishing ability of extinguisher nozzle 120.

Figure 5:
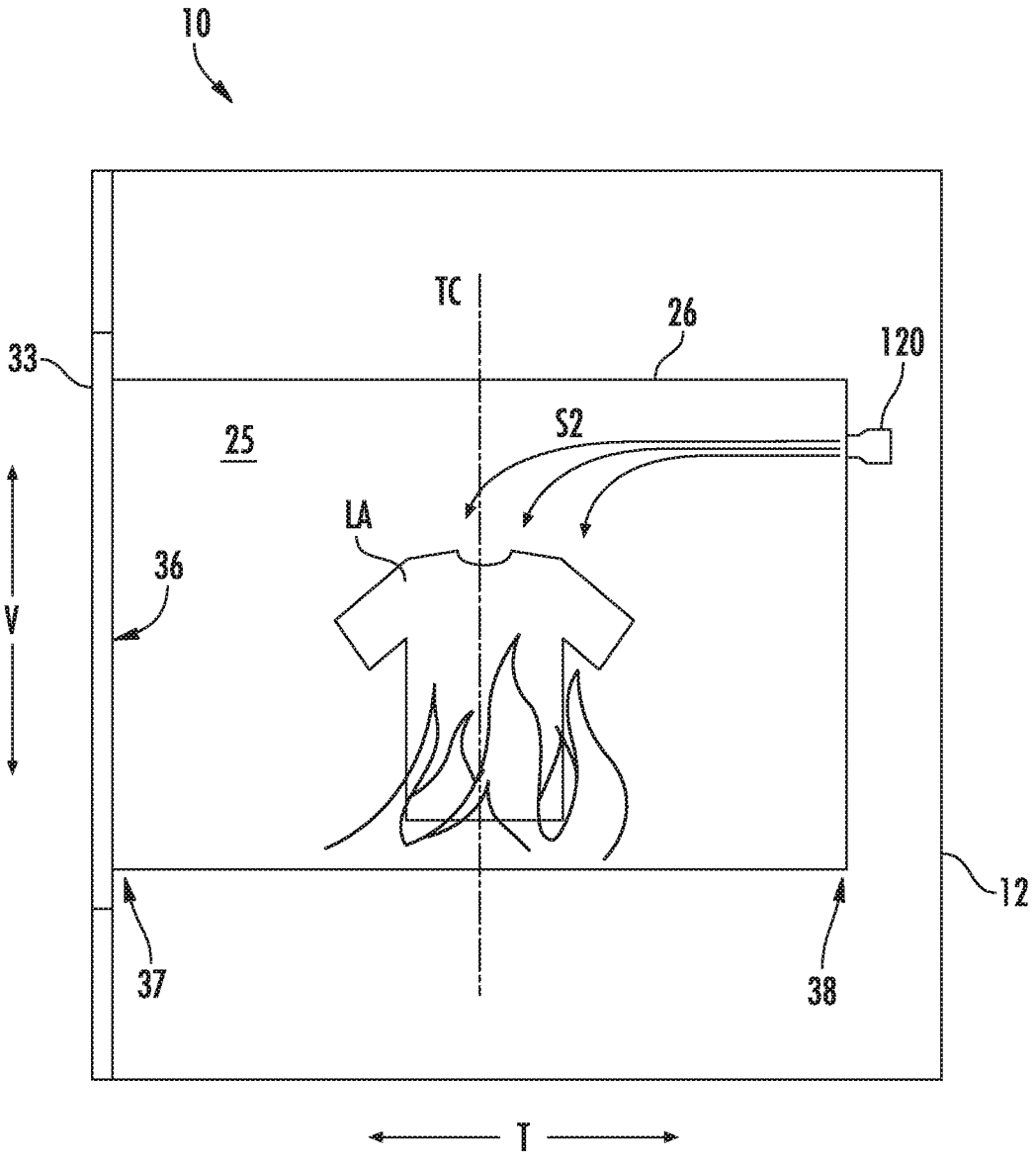
FIG. 5 provides a side schematic view of the dryer appliance and depicts the fire extinguishing system performing the extinguishing operation.

FIG. 5 provides a side schematic view of dryer appliance 10. Particularly, FIG. 5 depicts extinguisher nozzle 120 directing a stream of water S2 into chamber 25 to extinguish the detected fire. As depicted, drum 26 defines a transverse centerline TC or plane positioned midway between front portion 37 and rear portion 38 of drum 26 along the transverse direction T. As depicted, at least a portion of the water stream S2 ejected from extinguisher nozzle 120 into chamber 25 reaches at least the transverse centerline TC of drum 26. In this manner, the ejected water is more likely to extinguish the detected fire. In yet embodiments, at least a portion of the water stream S2 ejected from extinguisher nozzle 120 into chamber 25 reaches at least an interior side 36 of door 33. In this way, at least a portion of the ejected water travels the entire transverse length of drum 26, and consequently, is more likely to extinguish the detected fire. Controller 56 can control the mass flow rate of the water into fire extinguishing system 100 to generate such streams, e.g., by controlling the valve position of water inlet valve 110 in the first position. Additionally or alternatively, extinguisher nozzle 120 can be configured to generate such streams.

Returning to FIG. 4, in some embodiments, in response to receiving an input indicating that a fire is present within dryer appliance 10, controller 56 is configured to cause drum 26 to cease rotating about its axis of rotation. Moreover, controller 56 can also cease operation of conditioning system 40 (FIG. 2) as well as blower fan 48 (FIG. 2), among other possible components. In this manner, the detected fire ceases being a moving target and airflow to fire is decreased. Moreover, by ceasing operation of conditioning system 40, heated air will cease being introduced into chamber 25 of drum 26.

In some embodiments, as noted, water inlet valve 110 is a control valve that can be controlled such that the flow rate of the water through water inlet valve 110 can be controlled, e.g., based at least in part on one or more control commands received from controller 56. In such embodiments, the first position can include at least two valve positions. For instance, the two valve positions can include a halfway open position and a fully open position, among other possible open positions. Accordingly, controller 56 can cause water inlet valve 110 to adjust the flow rate of water therethrough, e.g., by adjusting the valve position of water inlet valve 110 while in the first position. By way of example, in response to receiving an input indicating that a fire is present within dryer appliance 10, e.g., within chamber 25 of drum 26, controller 56 can be configured to cause water inlet valve 110 to move to the first position, and more specifically, water inlet valve 110 can be controlled such that the valve position of water inlet valve 110 is moved to a halfway open position, i.e., a position that is halfway between a fully open position and a closed position. If the fire has not been extinguished after a predetermined time (as determined by signals received from fire detection device 126), controller 56 can cause water inlet valve 110 to adjust the flow rate of the water flowing therethrough by causing water inlet valve 110 to move its valve position to a fully open position, e.g., to increase the flow rate of the water passing through water inlet valve 110 and ultimately increase the extinguishing ability of fire extinguishing system 100. By initially positioning the valve position of the water inlet valve 110 at the halfway open position, cleanup of the ejected water may be less extensive.

As fire extinguishing system 100 is actively extinguishing a detected fire, controller 56 can continue to receive inputs from fire detection device 126. Particularly, controller 56 can receive one or more inputs from fire detection device 126 indicating whether the detected fire is still active, i.e., whether the fire has been extinguished. By way of example, fire detection device 126 can be a temperature sensing device. In such an example, controller 56 can receive one or more inputs from fire detection device 126 indicative of the temperature within chamber 25 of drum 26. Controller 56 can determine whether the sensed temperature is less than a predetermined threshold (e.g., a predetermined temperature threshold).

On one hand, when controller 56 determines that the sensed temperature is not less than the predetermined threshold, controller 56 continues controlling fire extinguishing system 100 to extinguish the detected fire. On the other hand, when controller 56 determines that the sensed temperature is less than the predetermined threshold, controller 56 ceases extinguishing operations. Particularly, controller 56 can cause water inlet valve 110 to move to the second position to stop the flow of water from extinguisher nozzle 120.

It will be appreciated that controller 56 can cease extinguishing operations based on other criteria. As one example, controller 56 can cease extinguishing operations after performing such operations for a predetermined time, e.g., five (5) minutes. As another example, fire detection device 126 can be a camera operable to capture one or more images (e.g., still image and/or video) of chamber 25 of drum 26. Based at least in part on the one or more captured images, controller 56 can determined whether the fire is extinguished in drum 26.

Figure 6:
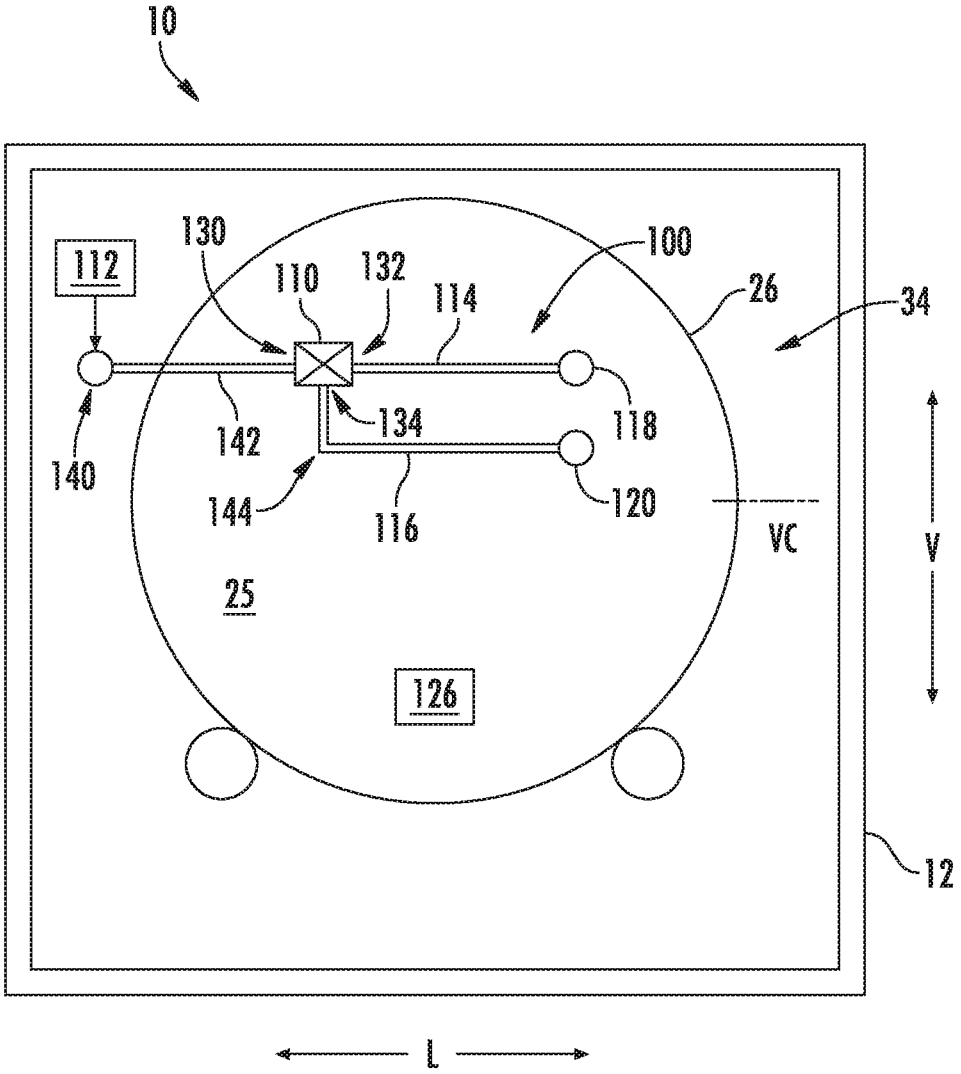
FIG. 6 provides a rear schematic view of a dryer appliance and depicts a fire extinguishing system thereof in accordance with exemplary embodiments of the present disclosure.

FIG. 6 provides a rear schematic view of a dryer appliance 10 and depicts a fire extinguishing system 100 thereof in accordance with exemplary embodiments of the present disclosure. The dryer appliance 10 and fire extinguishing system 100 thereof of FIG. 6 in configured in a similar manner as the dryer appliance and fire extinguishing system thereof described with reference to FIGS. 1 through 5 except as provided below. In FIG. 6 rear panel 16 of cabinet 12 has been removed for illustrative purposes.

For this embodiment, dryer appliance 10 has an inlet connector or port 140 that defines an inlet to dryer appliance 10. Water from water supply 112 enters dryer appliance 10 through the inlet defined by inlet port 140. An inlet conduit 142 (e.g., a hose) fluidly connects inlet port 140 with water inlet valve 110. More particularly, inlet conduit 142 fluidly connects inlet port 140 with inlet 130 of water inlet valve 110. Inlet port 140 can include an elbow, e.g., a ninety degree (90°) elbow, that fluidly connects water supply 112 with inlet conduit 142. First delivery conduit 114 fluidly connects first outlet 132 of water inlet valve 110 with steam nozzle 118 and second delivery conduit 116 fluidly connects second outlet 134 of water inlet valve 110 with extinguisher nozzle 120 as described above. Notably, for this embodiment, extinguishing nozzle 120 is positioned below steam nozzle 118 along the vertical direction V. Moreover, for this embodiment, fire detection device 126 is positioned below a vertical centerline VC along the vertical direction V. The vertical centerline VC a centerline or plane that is positioned midway between the top and bottom of drum 26 along the vertical direction V. By positioning fire detection device 126 below the vertical centerline VC along the vertical direction V, fire detection device 126 can detect fires more quickly, e.g., compared to other positions.

Although specific features of various embodiments may be shown in some drawings and not in others, this is for convenience only. In accordance with the principles of the present disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet;

a drum rotatably mounted within the cabinet, the drum defining a chamber for receipt of articles for drying;

a steam nozzle in fluid communication with the chamber of the drum;

an extinguisher nozzle in fluid communication with the chamber of the drum, wherein the steam nozzle and the fire extinguisher nozzle are separate components;

a water inlet valve in fluid communication with a water supply, the water inlet valve being movable to a first position and a second position, and wherein:

i) when the water inlet valve is in the first position, the water inlet valve allows water to flow from the water supply downstream to the extinguisher nozzle and the extinguisher nozzle directs a stream of water into the chamber, and ii) when the water inlet valve is in the second position, the water inlet valve prevents water from flowing downstream to the extinguisher nozzle.

2. The dryer appliance of claim 1, further comprising:

a fire detection device operable to detect a fire.

3. The dryer appliance of claim 2, wherein the fire detection device has a temperature sensing device operable to sense a temperature of air within the chamber of the drum.

4. The dryer appliance of claim 2, further comprising:

a controller communicatively coupled with the fire detection device and the water inlet valve, the controller being configured to:

receive, from the fire detection device, an input indicating detection of the fire; and in response to the received input, cause the water inlet valve to move to the first position.

5. The dryer appliance of claim 1, wherein when the water inlet valve is in the first position, the water inlet valve prevents water from flowing downstream to the steam nozzle.

6. The dryer appliance of claim 1, wherein when the water inlet valve is in the first position, the water inlet valve allows water to flow from the water supply downstream to the steam nozzle and the steam nozzle directs water into the chamber to form a mist or steam therein.

7. The dryer appliance of claim 1, wherein when the water inlet valve is in the second position, the water inlet valve allows water to flow from the water supply downstream to the steam nozzle and the steam nozzle directs water into the chamber to form a mist or steam therein.

8. The dryer appliance of claim 1, wherein when the water inlet valve is in the second position, the water inlet valve prevents water from flowing from the water supply into the dryer appliance.

9. The dryer appliance of claim 4, further comprising:

a fire detection device operable to detect a fire; and a controller communicatively coupled with the fire detection device and the water inlet valve, the controller being configured to:

receive, from the fire detection device, a second input indicating whether the fire has been extinguished; and in response to the received second input, cause the water inlet valve to adjust a flow rate of water flowing therethrough to the extinguisher nozzle.

10. The dryer appliance of claim 9, wherein in causing the water inlet valve to adjust the flow rate of water flowing therethrough in response to the received second input, the controller is configured to cause the water inlet valve to increase the flow rate of water flowing therethrough to the extinguisher nozzle.

11. The dryer appliance of claim 9, wherein the controller is further configured:

determine whether the fire has been extinguished based at least in part on the received second input; and when the fire has been extinguished, cause the water inlet valve to move to the second position.

12. The dryer appliance of claim 1, wherein the steam nozzle has an outlet having a diameter and the extinguisher nozzle has an outlet having a diameter, and wherein the diameter of the outlet of the extinguisher nozzle is greater than the diameter of the outlet of the steam nozzle.

13. The dryer appliance of claim 1, further comprising:

a rear drum support positioned at a rear portion of the drum and defining one or more openings, wherein the steam nozzle is in fluid communication with the chamber of the drum via the one or more openings and the extinguisher nozzle is in fluid communication with the chamber of the drum via the one or more openings.

14. The dryer appliance of claim 1, wherein the water supply is a continuous water supply.

15. The dryer appliance of claim 1, wherein the drum extends between a front portion and a rear portion along a transverse direction, and wherein the drum defines a transverse centerline midway between the front portion and the rear portion of the drum, and wherein when the extinguisher nozzle directs the stream of water into the chamber, at least a portion of the stream of water ejected from the extinguisher nozzle reaches at least the transverse centerline of the drum.

16. A dryer appliance, comprising:

a cabinet;

a drum rotatably mounted within the cabinet, the drum defining a chamber for receipt of articles for drying;

a steam nozzle in fluid communication with the chamber of the drum;

an extinguisher nozzle in fluid communication with the chamber of the drum, wherein the steam nozzle and the fire extinguisher nozzle are separate components;

a water inlet valve in fluid communication with a water supply, the steam nozzle, and the extinguisher nozzle;

a fire detection device operable to detect fires; and a controller communicatively coupled with the fire detection device and the water inlet valve, the controller configured to:

receive, from the fire detection device, an input indicating that a fire is present in the dryer appliance; and in response to the received input, cause the water inlet valve to allow water from the water supply to flow downstream to the extinguisher nozzle so that the extinguisher nozzle directs a stream of water into the chamber.

17. The dryer appliance of claim 16, wherein the water inlet valve has a first outlet and a second outlet, and wherein the dryer appliance further comprises:

a first delivery conduit fluidly connecting the first outlet of the water inlet valve with the steam nozzle; and a second delivery conduit fluidly connecting the second outlet of the water inlet valve with the extinguisher nozzle.

18. The dryer appliance of claim 16, further comprising:

a rear drum support positioned at a rear portion of the drum and enclosing the chamber, the rear drum support defining one or more openings, and wherein the steam nozzle is in fluid communication with the chamber of the drum via the one or more openings and the extinguisher nozzle is in fluid communication with the chamber of the drum via the one or more openings.

19. The dryer appliance of claim 16, wherein the controller is further configured to:

receive, from the fire detection device, a second input indicating whether the fire has been extinguished; and when the second input indicates that the fire has been extinguished, cause the water inlet valve to prevent water from flowing to the extinguisher nozzle.

20. A dryer appliance, comprising:

a cabinet;

a drum rotatably mounted within the cabinet, the drum defining a chamber for receipt of articles for drying;

a steam nozzle in fluid communication with the chamber of the drum;

an extinguisher nozzle in fluid communication with the chamber of the drum;

a fire detection device operable to detect a fire;

a water inlet valve in fluid communication with a water supply, the water inlet valve being movable to a first position and a second position, and wherein:

i) when the water inlet valve is in the first position, the water inlet valve allows water to flow from the water supply downstream to the extinguisher nozzle and the extinguisher nozzle directs a stream of water into the chamber, and ii) when the water inlet valve is in the second position, the water inlet valve prevents water from flowing downstream to the extinguisher nozzle; and a controller communicatively coupled with the fire detection device and the water inlet valve, the controller being configured to:

receive, from the fire detection device, an input indicating detection of the fire;

in response to the received input, cause the water inlet valve to move to the first position;

receive, from the fire detection device, a second input indicating whether the fire has been extinguished; and in response to the received second input, cause the water inlet valve to:

when the second input indicates the fire has not been extinguished, increase the flow rate of water flowing therethrough to the extinguisher nozzle; and when the second input indicates the fire has been extinguished, cause the water inlet valve to move to the second position.

* * * * *